US006455994B1

(12) United States Patent
Bae

(10) Patent No.: US 6,455,994 B1
(45) Date of Patent: Sep. 24, 2002

(54) ELECTRODE OF ELECTRON GUN FOR COLOR CATHODE RAY TUBE

(75) Inventor: Min-cheol Bae, Suwon (KR)

(73) Assignee: Samsung Display Devices Co., LTD, Suwon (KR)

( * ) Notice: Subject to any disclaimer, the term of this patent is extended or adjusted under 35 U.S.C. 154(b) by 0 days.

(21) Appl. No.: 09/389,023

(22) Filed: Sep. 2, 1999

(30) Foreign Application Priority Data

Dec. 2, 1998 (KR) ..... 98-52518

(51) Int. Cl.[7] ..... H01J 29/58

(52) U.S. Cl. ..... 313/414; 313/458; 313/460; 313/409

(58) Field of Search ..... 313/409, 410, 313/411, 412, 414, 417, 449, 458, 460, 426, 427

(56) References Cited

U.S. PATENT DOCUMENTS

| | | | | |
|---|---|---|---|---|
| 4,370,592 A | | 1/1983 | Hughes et al. | 313/414 |
| 4,510,413 A | | 4/1985 | Yabe et al. | 313/460 |
| 5,834,887 A | * | 11/1998 | Spanjer et al. | 313/412 |

* cited by examiner

*Primary Examiner*—Nimeshkumar D. Patel
*Assistant Examiner*—Thelma Sheree Clove
(74) *Attorney, Agent, or Firm*—Leydig Voit & Mayer, Ltd.

(57) ABSTRACT

An electrode of an electron gun for a cathode ray tube including a first electrode member having a large-diameter electron beam passing aperture through which three electron beams pass, and a second electrode member in the first electrode member so as to be spaced apart from the edge of the first electrode member and having three small-diameter electron beam passing apertures, wherein a slanted portion extends from the edge of the first electrode member toward the interior of the large-diameter electron beam passing aperture.

4 Claims, 4 Drawing Sheets

ELECTRODE OF ELECTRON GUN FOR COLOR CATHODE RAY TUBE

BACKGROUND OF THE INVENTION

1. Field of the Invention

The present invention relates to an electron gun for a color cathode ray tube, and more particularly, to an electrode of an electron gun for a color cathode ray tube which can extend an electric field for forming an electronic lens.

2. Description of the Related Art

In a general electron gun for a color cathode ray tube, spherical aberration and focusing characteristics are greatly affected by a main lens. Thus, in order to obtain good focusing characteristics, the spherical diameter of the main lens must be increased. Also, in order to reduce deflection power, it is preferable to reduce the diameter of the neck portion of a cathode ray tube. In this case, the area in which electron beam passing apertures of an electrode are located is decreased. It is necessary to increase the area of the electron beam passing apertures as much as possible in a limited area.

However, in an in-line electron gun, since three electron beam passing apertures are formed at at least two electrodes constituting an electronic lens in an in-line configuration, it is impossible to make the diameter of an electron beam passing aperture larger than a distance between centers of two adjacent electron beam passing apertures.

An electrode for solving the above-described problem is disclosed in U.S. Pat. No. 4,510,413. This electrode comprises a flat portion 11 having three electron beam passing apertures RH, GH and BH, a cylindrical skirt portion 12 extending from the edge of the flat portion 11, and an embedded portion 13 extending from an end of the skirt portion 12 in a radial direction, as shown in FIG. 1. A tapering portion 14 leading to the flat portion 11 is formed at the edges of the respective electron beam passing apertures RH, GH and BH.

In the above-described electrode, the tapering portion 14 extends the electric field to increase the area of an electronic lens. However, since the electron beam passing apertures RH, GH and BH are independently formed, the effect of increasing the electronic lens is not satisfactory.

FIG. 2 shows an example of an electrode for forming a large-diameter lens, which is disclosed in U.S. Pat. No. 4,370,592.

As shown in FIG. 2, burring portions 5*b* and 6*b* are formed at edges of an electron outlet surface 5*a* of a focusing electrode 5 and an electron inlet surface 6*a* of a final accelerating electrode 6, and large-diameter electron beam passing apertures 5H ' and 6H ' through which R, G and B electron beams pass commonly by slanted surfaces 5*c* and 6*c* recessed a predetermined depth from the burring portions 5*b* and 6*b*. R, G and B small-diameter electron beam passing apertures are formed adjacent the slanted surfaces 5*c* and 6*c*.

According to the above-described electrode, an electric field can be extended by the large-diameter electron beam passing apertures 5H and 6H. However, a continuously smooth electric field cannot be formed around the burring portions 5*b* and 6*b*. This finally distorts the electronic lens formed by the electric field.

In particular, since the small-diameter electron beam passing apertures 5H ' and 6H' are formed adjacent the slanted surfaces 5*c* and 6*c*, there is a limit in increasing the eccentric distance between the small-diameter electron beam passing apertures 5H ' and 6H'.

SUMMARY OF THE INVENTION

To solve the above problems, it is an objective of the present invention to provide an electrode of an electron gun for a color cathode ray tube which can reduce spherical aberration and improve focusing characteristics, by extending an electric field for forming a main lens.

Accordingly, to achieve the above objective, there is provided an electrode of an electron gun for a cathode ray tube comprising a first electrode member having a large-diameter electron beam passing aperture through which three electron beams pass, and a second electrode member installed in the first electrode member so as to be spaced apart from the edge of the first electrode member and having three small-diameter electron beam passing apertures, wherein a slant portion is formed to extend from the edge of the first electrode member toward the interior of the large-diameter electron beam passing aperture.

Also, slant surfaces extending to the surface of the second electrode member are formed at circumferences of the small-diameter electron beam apertures of the second electrode member.

According to another aspect of the present invention, an electrode of an electron gun for a cathode ray tube comprising a first electrode member having a large-diameter electron beam passing aperture through which three electron beams pass and a burring portion formed at the edge of the large-diameter electron beam passing aperture, and a second electrode member installed in the first electrode member so as to be spaced apart from the burring portion and having three small-diameter electron beam passing apertures, wherein slant surfaces extending to the surface of the second electrode member are formed at the circumferences of the small-diameter electron beam passing apertures of the second electrode member.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENT

Figure 1:
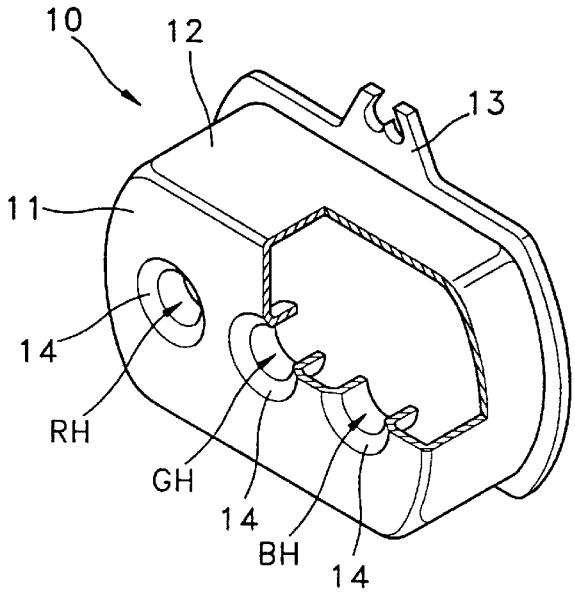
FIG. 1 (PRIOR ART)
FIG. 1 is a perspective view of a conventional electrode of an electron gun.
Figure 2:
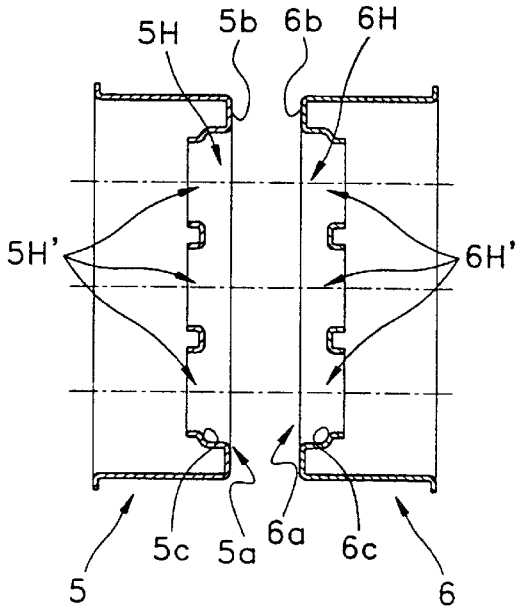
FIG. 2 (PRIOR ART)
FIG. 2 is a cross-sectional view of a conventional electrode having large-diameter electron beam passing apertures.
Figure 3:
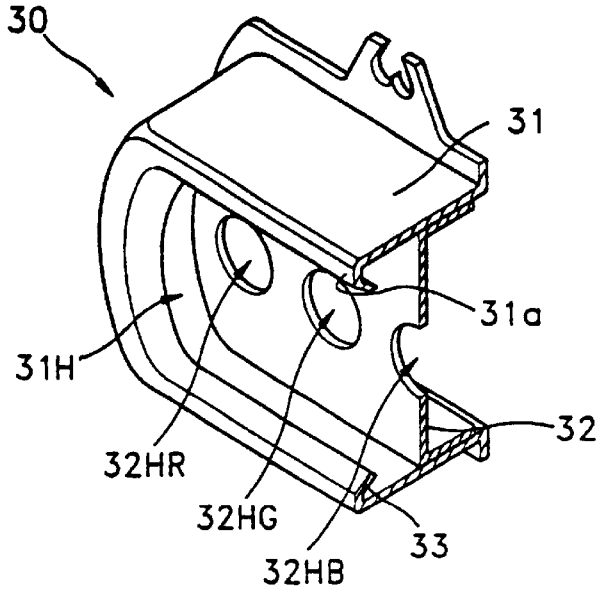
FIG. 3 is a partially exploded perspective view showing an electrode of an electron gun according to an embodiment of the present invention.

FIG. 3 shows an electrode of an electron gun for a color cathode ray tube according to an embodiment of the present invention.

Referring to FIG. 3, an electrode 30 includes a first electrode member 31 having a large-diameter electron beam passing aperture 31H through which three electron beams for exciting red, green and blue phosphors pass, and a second electrode member 32 installed in the first electrode member 31 and having three small-diameter electron beam passing apertures 32HR, 32HG and 32HB.

Figure 4:
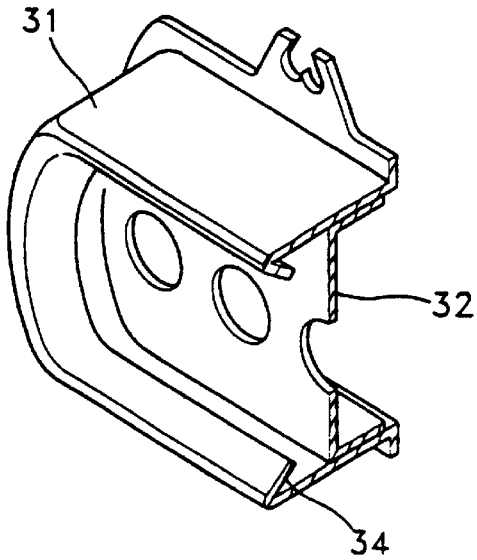
FIG. 4 is a partially exploded perspective view showing an electrode of an electron gun according to another embodiment of the present invention.

A burring portion 31*a* is formed at an edge of the first electrode member 31 to define the large-diameter electron beam passing aperture 31H. Here, slanted, i.e. oblique portion 33 forming a predetermined angle to the large-diameter electron beam passing aperture 31H is provided at an edge of the burring portion 31*a*. The slanted portion 33 preferably has a uniform width along the edge of the large-diameter electron beam passing aperture 31H. Alternatively, the burring portion may have only the slanted portion 34, as shown in FIG. 4.

Also, the second electrode member 32 spaced apart from an edge of the burring portion 31*a* contacts the inner surface of the first electrode member 31.

Figure 5:
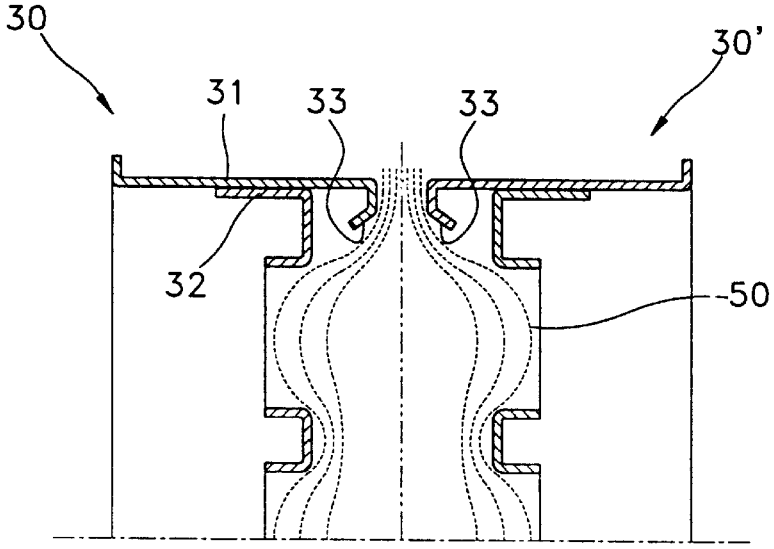
FIG. 5 is a cross-sectional view showing an electric field distribution state for the electrode of an electron gun shown in FIG. 3.

The electrode having the above-described configuration is employed in an electron gun for a color cathode ray tube where two electrodes 30 and 30' face each other, as shown in FIG. 5.

If a predetermined voltage is applied to the electrodes 30 and 30', an electromagnetic line (not shown) is formed therebetween. Equipotential lines 50 for forming an electronic lens are formed in a direction normal to of the electromagnetic line. The distribution of the equipotential lines 50 is extended due to the slanted portion 33. In other words, since the equipotential lines 50 are smoothly distributed along the slanted portion 33, the area of the equipotential lines 50 forming the electronic lens can be substantially extended. In particular, distortion of the electronic lens, which is due to the concentrated electric field at the edges of the conventional large-diameter electrode, can be prevented.

Figure 6:
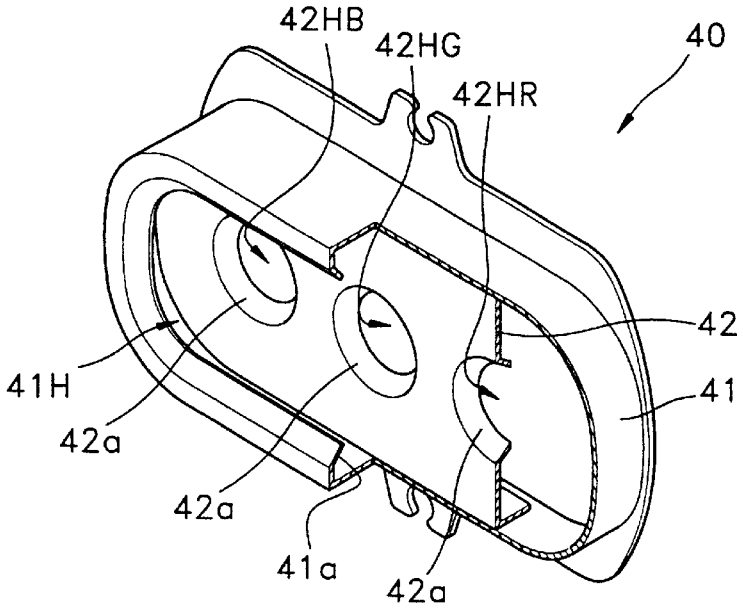
FIG. 6 is a partially exploded perspective view showing an electrode of an electron gun according to still another embodiment of the present invention.

FIG. 6 shows an electrode of an electron gun according to another embodiment of the present invention.

Referring to FIG. 6, an electrode 40 includes a first electrode member 41 having a large-diameter electron beam passing aperture 41H and a second electrode member 42 installed in the first electrode member 41.

A slant portion 41*a* slanted toward the large-diameter electron beam passing aperture 41H is provided at an edge of the first electrode member 41. The second electrode member 42 is spaced apart from the slanted portion 41*a* and has three small-diameter electron beam passing apertures 42HR, 42HG and 42HB. The slanted portion 41*a* preferably has a uniform width along the edge of the large-diameter electron beam passing aperture 41H.

Slanted surfaces 42*a* extending to the surface of the second electrode member 42 are located at the circumferences of the small-diameter electron beam passing apertures 42HR, 42HG and 42HB.

In the electrode according to this embodiment, the operation of the slanted portion 41*a* formed at the edge of the large-diameter electron beam passing aperture 41H is the same as that according to the above-described embodiment. Also, a sharp change in equipotential lines can be prevented by the slanted surfaces 42*a* at the small-diameter electron beam passing apertures 42HR, 42HG and 42HB.

Figure 7:
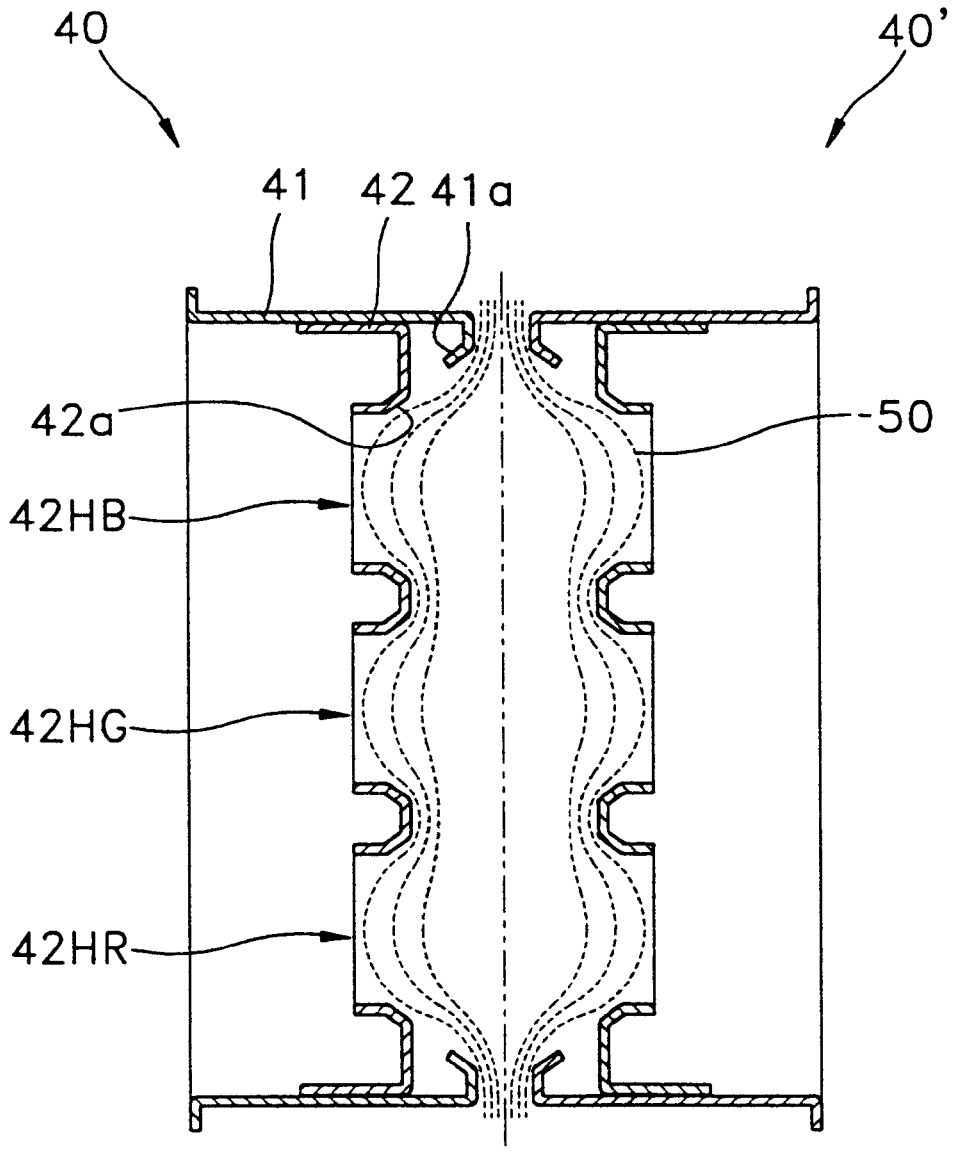
FIG. 7 is a cross-sectional view showing an electric field distribution state for the electrode of an electron gun shown in FIG. 6.

As shown in FIG. 7, since equipotential lines 50 induced to the small-diameter electron beam passing apertures 42HR, 42HG and 42HB are formed along the slanted surfaces 42*a*, the radii of curvature thereof are increased. Thus, by applying an equal voltage is applied to electrodes 40 and 40', a large-diameter electronic lens can be attained. Also, as the radii of curvature of the equipotential lines increase, the magnification of an electron beam is decreased, thereby reducing spherical aberration of the electronic lens. The effect of increasing the electronic lens can be increased through multiple steps of a slant portion of a large-diameter electron beam passing aperture and slanted surfaces of small-diameter electron beam passing apertures.

As described above, in the electrode according to the present invention, a large-diameter electronic lens can be attained slanted surfaces at the edges of small-diameter electron beam passing apertures or a slanted portion at the edge of a large-diameter electron beam passing aperture. Also, the electrode according to the present invention can be applied to a cathode ray tube having a small-diameter neck portion for increasing deflection force.

Although the present invention has been described with reference to illustrative embodiments, these are only provided by way of example and various changes and modifications may be effected by one skilled in the art within the scope of the invention as defined in the appended claims.

What is claimed is:

1. An electrode for an electron gun of a color cathode ray tube, the electrode comprising:

a tubular first electrode member having a tubular surface with first and second ends, a single aperture for passing first, second, and third electron beams, and a periphery at the first end bent inwardly, extending toward the second end, including an edge, and having an oblique portion contiguous to the edge that is oblique to the tubular surface; and a generally planar second electrode member mounted to the first electrode member, within the tubular surface, spaced from the first and second ends, and including first, second, and third electron beam passing holes for passing the first, second, and third electron beams, respectively.

2. The electrode according to claim 1, wherein the first electrode member includes, at the first end, a burring portion, transverse to the tubular surface and connecting the tubular surface to the oblique portion.

3. The electrode according to claim 2, wherein the second electrode member includes, at peripheries of each of the first, second, and third electron beam passing holes, slanted portions protruding toward the second end of the first electrode member and oblique to the tubular surface.

4. The electrode according to claim 1, wherein the second electrode member includes, at peripheries of each of the first, second, and third electron beam passing holes, slanted portions protruding toward the second end of the first electrode member and oblique to the tubular surface.

* * * * *